US009816742B2

(12) United States Patent
Rite et al.

(10) Patent No.: US 9,816,742 B2
(45) Date of Patent: Nov. 14, 2017

(54) VARIABLE FREQUENCY DRIVE APPARATUSES, SYSTEMS, AND METHODS AND CONTROLS FOR SAME

(71) Applicant: TRANE INTERNATIONAL INC., Piscataway, NJ (US)

(72) Inventors: Raymond Walter Rite, Tyler, TX (US); Chuan Yan, Tyler, TX (US); Bill Brandt, Tyler, TX (US)

(73) Assignee: Trane International Inc.

( * ) Notice: Subject to any disclaimer, the term of this patent is extended or adjusted under 35 U.S.C. 154(b) by 628 days.

(21) Appl. No.: 14/207,884

(22) Filed: Mar. 13, 2014

(65) Prior Publication Data

US 2014/0260343 A1 Sep. 18, 2014

Related U.S. Application Data

(60) Provisional application No. 61/779,473, filed on Mar. 13, 2013, provisional application No. 61/791,184, filed on Mar. 15, 2013.

(51) Int. Cl.
*F25B 49/02* (2006.01)
*F04C 28/06* (2006.01)
(Continued)

(52) U.S. Cl.
CPC ..... *F25B 49/022* (2013.01); *F04C 28/06* (2013.01); *F04C 28/28* (2013.01);
(Continued)

(58) Field of Classification Search
CPC ..... F04C 23/008; F04C 28/28; F04C 18/0207–18/0223; F04C 28/00;
(Continued)

(56) References Cited

U.S. PATENT DOCUMENTS 4,820,130 A 4/1989 Eber et al.
5,006,045 A 4/1991 Shimoda et al.
(Continued)

FOREIGN PATENT DOCUMENTS

WO 2006031433 A2 3/2006

*Primary Examiner* — Alexander Comley
(74) *Attorney, Agent, or Firm* — Taft Stettinius & Hollister LLP

(57) ABSTRACT

Detection of reverse rotation or operation of a refrigerant compressor is provided. In one aspect, a detection technique includes starting the compressor and determining the compressor is rotating in a reverse direction if a dome temperature of the compressor fails to exceed a first predetermined threshold at or before expiration of a first predetermined period of time following starting, the refrigerant pressure at a refrigerant inlet of the compressor remains constant for a second predetermined period of time following starting, and/or the frequency of pressure oscillations of the refrigerant at the refrigerant inlet exceeds a second predetermined threshold. Another technique for determining the compressor is rotating in the reverse direction involves analyzing a waveform associated with motor current, motor torque, or refrigerant pressure. Further embodiments, forms, features, and aspects shall become apparent from the description and drawings.

26 Claims, 13 Drawing Sheets

(51) Int. Cl.
*F04C 28/28* (2006.01)
*F04C 18/02* (2006.01)

(52) U.S. Cl.
CPC .... *F04C 18/0215* (2013.01); *F04C 2240/403* (2013.01); *F04C 2270/14* (2013.01); *F04C 2270/18* (2013.01); *F04C 2270/19* (2013.01); *F04C 2270/72* (2013.01); *F25B 2339/047* (2013.01); *F25B 2500/26* (2013.01)

(58) Field of Classification Search
CPC ..... F04C 28/04–28/06; F04C 2270/03–2270/035; F04C 2270/07–2270/075; F04C 2270/18–2270/185; F04C 2270/72; F25B 49/025; F25B 49/022; F25B 31/02–31/026; H02P 6/30; H02P 1/22; H02P 6/22; H02P 7/03; H02P 29/50; F04D 15/02; F04D 15/0245–15/254; F04D 15/0272–15/0281; F04D 15/0094; F04D 27/001; F04B 49/06; F04B 49/065; F04B 51/00
USPC ..... 417/44.11, 18, 44.1, 44.2, 280, 417/410.3–410.5, 902; 62/226, 62/228.3–230
See application file for complete search history.

(56) References Cited

U.S. PATENT DOCUMENTS

| | | | | |
|---|---|---|---|---|
| 5,200,872 | A * | 4/1993 | D'Entremont | H02H 7/08 310/68 C |
| 6,041,605 | A | 3/2000 | Heinrichs | |
| 6,210,119 | B1 * | 4/2001 | Lifson | F04C 28/28 417/18 |
| 7,048,511 | B2 | 5/2006 | Weng | |
| 7,389,649 | B2 | 6/2008 | Pham et al. | |
| 7,412,842 | B2 | 8/2008 | Pham | |
| 7,617,691 | B2 | 11/2009 | Street et al. | |
| 7,748,225 | B2 | 7/2010 | Butler et al. | |
| 2003/0151383 | A1 * | 8/2003 | Hayashi | H02P 6/16 318/661 |
| 2009/0039808 | A1 * | 2/2009 | Hashimoto | F04B 35/04 318/400.02 |
| 2009/0292395 | A1 | 11/2009 | DiFatta et al. | |
| 2011/0083454 | A1 | 4/2011 | Kopko et al. | |

* cited by examiner

VARIABLE FREQUENCY DRIVE APPARATUSES, SYSTEMS, AND METHODS AND CONTROLS FOR SAME

CROSS REFERENCE

The present application claims the benefit of U.S. Application No. 61/779,473, filed Mar. 13, 2013, and the benefit of U.S. Application No. 61/791,184 filed Mar. 15, 2013, and the disclosure of both applications is hereby incorporated by reference.

BACKGROUND

The present invention generally relates to control of a heating, ventilation, and air conditioning (HVAC) system, and more particularly, but not exclusively, to operating a variable speed compressor and associated components in accordance with predefined valid operating parameters. Compressors in HVAC systems raise the pressure of a refrigerant from an evaporator pressure to a condenser pressure. The evaporator pressure is sometimes referred to as the suction pressure and the condenser pressure is sometimes referred to as the discharge pressure. At the suction pressure, the refrigerant is capable of cooling a desired medium. These systems may utilize many compressor types, including rotary screw compressors and scroll compressors amongst others. A variety of conditions may cause the compressor to operate or rotate in a reverse direction where, for example, the compressor will move or attempt to move refrigerant from the direction of a refrigerant outlet of the compressor toward a refrigerant inlet of the compressor. Amongst other things, operation of the compressor in this manner may create friction and undesired internal heat which can result in great stresses on compressor components and in turn lead to damage, failure and/or reduced durability or lifespan of the compressor or other system components. In some instances, it can be determined that the compressor is operating in reverse by detecting internal heat increases, and corrective action such as terminating operation of the compressor can be taken before the compressor or other system components are damaged. However, in certain forms, the detection of internal heat increases may not occur until after damage to the compressor has already occurred. Alleviating difficulties found in controlling heating, ventilation, and air conditioning systems remains an area of interest. Present approaches to this suffer from a variety of limitations and disadvantages relative to certain applications. Accordingly, there is a need for further contributions to this technology.

DISCLOSURE

For the purposes of clearly, concisely and exactly describing exemplary embodiments of the invention, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created, and that the invention includes and protects such alterations, modifications, and further applications of the exemplary embodiments as would occur to one skilled in the art.

SUMMARY

Detection of reverse rotation or operation of a refrigerant compressor is provided. In one aspect, a detection technique includes starting the compressor and determining the compressor is rotating in a reverse direction if a dome temperature of the compressor fails to exceed a first predetermined threshold at or before expiration of a first predetermined period of time following starting, the refrigerant pressure at a refrigerant inlet of the compressor remains constant for a second predetermined period of time following starting, and/or the frequency of pressure oscillations of the refrigerant at the refrigerant inlet exceeds a second predetermined threshold. Another technique for determining the compressor is rotating in the reverse direction involves analyzing a waveform associated with motor current, motor torque, or refrigerant pressure.

In one embodiment, a method for operating a compressor in a refrigerant loop includes starting the compressor and determining the compressor is rotating in a reverse direction. Determining the compressor is rotating in a reverse direction is performed in response to at least one of determining a temperature of a dome of the compressor fails to exceed a first predetermined threshold at or before expiration of a first predetermined period of time following starting; determining refrigerant pressure at a refrigerant inlet of the compressor remains constant for a second predetermined period of time following starting; and determining frequency of pressure oscillations of the refrigerant at the refrigerant inlet exceeds a second predetermined threshold.

In still another embodiment, a system includes a refrigerant compressor including a dome and a refrigerant inlet. The system also includes a controller configured to determine the compressor is rotating in a reverse direction in response to at least one of the temperature of the dome failing to exceed a first predetermined threshold at or before expiration of a first predetermined period of time following starting of the compressor; the refrigerant pressure at the refrigerant inlet remaining constant for a second predetermined period of time following starting of the compressor; and the frequency of pressure oscillations of the refrigerant at the refrigerant inlet exceeding a predetermined threshold.

In yet another embodiment, a method for operating a compressor in a refrigerant loop includes starting the compressor and analyzing one or more of a motor current waveform, a motor torque waveform, and a waveform of refrigerant pressure at a refrigerant outlet of the compressor. The method also includes determining the compressor is rotating in a reverse direction in response to at least one of determining the presence of a high frequency harmonic exceeding a first predetermined threshold on at least one of the one or more analyzed waveforms, and determining the summation of amplitude within a frequency band on at least one of the one or more analyzed waveforms exceeds a second predetermined threshold.

In another embodiment, a system includes a refrigerant compressor including a dome and a refrigerant outlet. The system also includes a controller configured to analyze one or more of a motor current waveform, a motor torque waveform, and a waveform of refrigerant pressure at the refrigerant outlet. The controller is further configured to determine the compressor is rotating in a reverse direction in response to at least one of determining the presence of a high frequency harmonic exceeding a first predetermined threshold on at least one of the one or more analyzed waveforms, and determining the summation of amplitude within a frequency band on at least one of the one or more analyzed waveforms exceeds a second predetermined threshold.

Other aspects include unique methods, techniques, systems, devices, kits, assemblies, equipment, and/or apparatus related to detecting or determining a refrigerant compressor is operating or rotating in a reverse direction.

Another embodiment is a system comprising a compressor having a compressor coil; a first fan associated with said compressor; an air handling unit having an air handling unit coil; a second fan associated with said air handling unit; said compressor coil and said air handling unit coil in communication with one another via a first pressure line and a second pressure line, a refrigerant is disposed within said compressor coil, said air handling unit coil, said first pressure line, and said second pressure line; a first pressure sensor operatively coupled to said first pressure line, and being structured to provide a first pressure signal associated with said refrigerant in said first pressure line; a second pressure sensor operatively coupled to said second pressure line, and being structured to provide a second pressure signal associated with said refrigerant in said second pressure line; and a controller structured to determine said first pressure signal and said second pressure sensor, and to control a speed of at least one of said compressor, said first fan, and said second fan in response thereto.

In some forms said controller further comprises a pressure sensor processing module structured to determine said first pressure signal and said second pressure signal and determine a first pressure value related to said refrigerant and a second pressure value related to said refrigerant. In some forms said controller further comprises a temperature processing module structured to determine a saturated evaporating temperature value of said refrigerant and a saturated condensing temperature value of said refrigerant in response to said first pressure value and said second pressure value.

In some forms said controller further comprises an operating module structured to determine an operating zone value in response to said saturated evaporating temperature value and said saturated condensing temperature value. In some forms said controller further comprises an action module structured to determine an operating action value in response to said operating zone value, wherein said operating action value includes at least one of slowing the speed of said compressor, slowing the speed of said first fan, slowing the speed of said second fan, and shutting down said compressor, said first fan and said second fan. In some forms said action module is further structured to determine said operating action value in response to an operating mode selected from the group consisting of a cooling mode and a heating mode. In some forms said controller further comprises a compressor control module structured to control said compressor in response to said operating action value. In some forms said controller further comprises a first fan control module structured to control said first fan in response to said operating action value. In some forms said controller further comprises a second fan control module structured to control said second fan in response to said operating action value. In some forms said operation action value is dependent on said operation zone value being outside a valid operating envelope defined by minimum and maximum saturated evaporating temperatures and minimum and maximum saturated condensing temperatures of said refrigerant.

A further embodiment is an apparatus comprising a compressor including a compressor fan; an air handling unit including an air handling unit fan; a refrigerant loop extending between said compressor and said air handling unit; a controller, including: a pressure sensor processing module structured to interpret a first pressure value and a second pressure value of a refrigerant in said refrigerant loop; a temperature processing module structured to determine a first temperature value and a second temperature value in response to said first pressure value and said second pressure value; and a control module structured to send a control signal in response to said first temperature value and said second temperature value to control a speed of at least one of said compressor, said compressor fan, and said air handling unit fan.

In some forms said control signal controls a speed of each of said compressor, said compressor fan, and said air handling unit fan. In some forms said first temperature value is a saturated evaporating temperature of said refrigerant and said second temperature value is a saturated condensing temperature of said refrigerant. In some forms said control signal is dependent on said saturated evaporating temperature and said saturated condensing temperature defining an operation value that lies outside a valid operating envelope defined by minimum and maximum saturated evaporating temperatures and minimum and maximum saturated condensing temperatures of said refrigerant.

Another embodiment is a method comprising operating a HVAC system having a compressor in communication with a first pressure line and a second pressure line, a refrigerant disposed in said first pressure line and said second pressure line, a first pressure sensor being coupled to said first pressure line, and a second pressure sensor being coupled to said second pressure line; compressing said refrigerant in said first pressure line and said second pressure line, such that one of said first pressure line and said second pressure line has a higher pressure than the other; generating a first pressure signal and a second pressure signal from said first pressure sensor and said second pressure sensor; interpreting said first pressure signal and said second pressure signal to determine a saturated evaporating temperature of said refrigerant and a saturated condensing temperature of said refrigerant; controlling said compressor in response to said saturated evaporating temperature and said saturated condensing temperature.

In some forms said controlling includes slowing down a speed of said compressor in response to said saturated evaporating temperature and said saturated condensing temperature defining an operation value that lies outside a valid operating envelope defined by minimum and maximum saturated evaporating temperatures and minimum and maximum saturated condensing temperatures of said refrigerant, wherein said operation value is either less than the minimum saturated evaporating temperature or between said minimum and maximum saturated evaporating temperatures while being greater than said maximum saturated condensing temperature. Some forms further comprise providing a fan associated with said compressor, and controlling a speed of said fan when in a cooling mode to lower said speed in response to said saturated evaporating temperature and said saturated condensing temperature defining an operation value that lies outside a valid operating envelope defined by minimum and maximum saturated evaporating temperatures and minimum and maximum saturated condensing temperatures of said refrigerant, wherein said operation value is less than said minimum saturated condensing temperature and between said minimum and maximum saturated evaporating temperatures.

Some forms further comprise operating an air handling unit having a fan associated therewith, and controlling a speed of said fan when in a cooling mode to slow said speed in response to said saturated evaporating temperature and said saturated condensing temperature defining an operation value that lies outside a valid operating envelope defined by minimum and maximum saturated evaporating temperatures and minimum and maximum saturated condensing temperatures of said refrigerant, wherein said operation value is greater than said maximum saturated evaporating temperature. Some forms further comprise operating an air handling unit having a fan associated therewith, and controlling a speed of said fan when in a heating mode to slow a speed of said fan in response to said saturated evaporating temperature and said saturated condensing temperature defining an operation value that lies outside a valid operating envelope defined by minimum and maximum saturated evaporating temperatures and minimum and maximum saturated condensing temperatures of said refrigerant, wherein said operation value is less than said minimum saturated condensing temperature and between said minimum and maximum saturated evaporating temperatures. In some forms said controlling includes shutting down said compressor when in a heating mode in response to said saturated evaporating temperature and said saturated condensing temperature defining an operation value that lies outside a valid operating envelope defined by minimum and maximum saturated evaporating temperatures and minimum and maximum saturated condensing temperatures of said refrigerant, wherein said operation value is greater than said maximum saturated evaporating temperature.

Further aspects, embodiments, forms, features, benefits, objects, and advantages shall become apparent from the detailed description and figures provided herewith.

DETAILED DESCRIPTION OF ILLUSTRATIVE EMBODIMENTS

Detection of reverse rotation or operation of a refrigerant compressor is provided. In one aspect, a detection technique includes starting the compressor and determining the compressor is rotating in a reverse direction if a dome temperature of the compressor fails to exceed a first predetermined threshold at or before expiration of a first predetermined period of time following starting, the refrigerant pressure at a refrigerant inlet of the compressor remains constant for a second predetermined period of time following starting, and/or the frequency of pressure oscillations of the refrigerant at the refrigerant inlet exceeds a second predetermined threshold. Another technique for determining the compressor is rotating in the reverse direction involves analyzing a waveform associated with motor current, motor torque, or refrigerant pressure.

Figure 1:
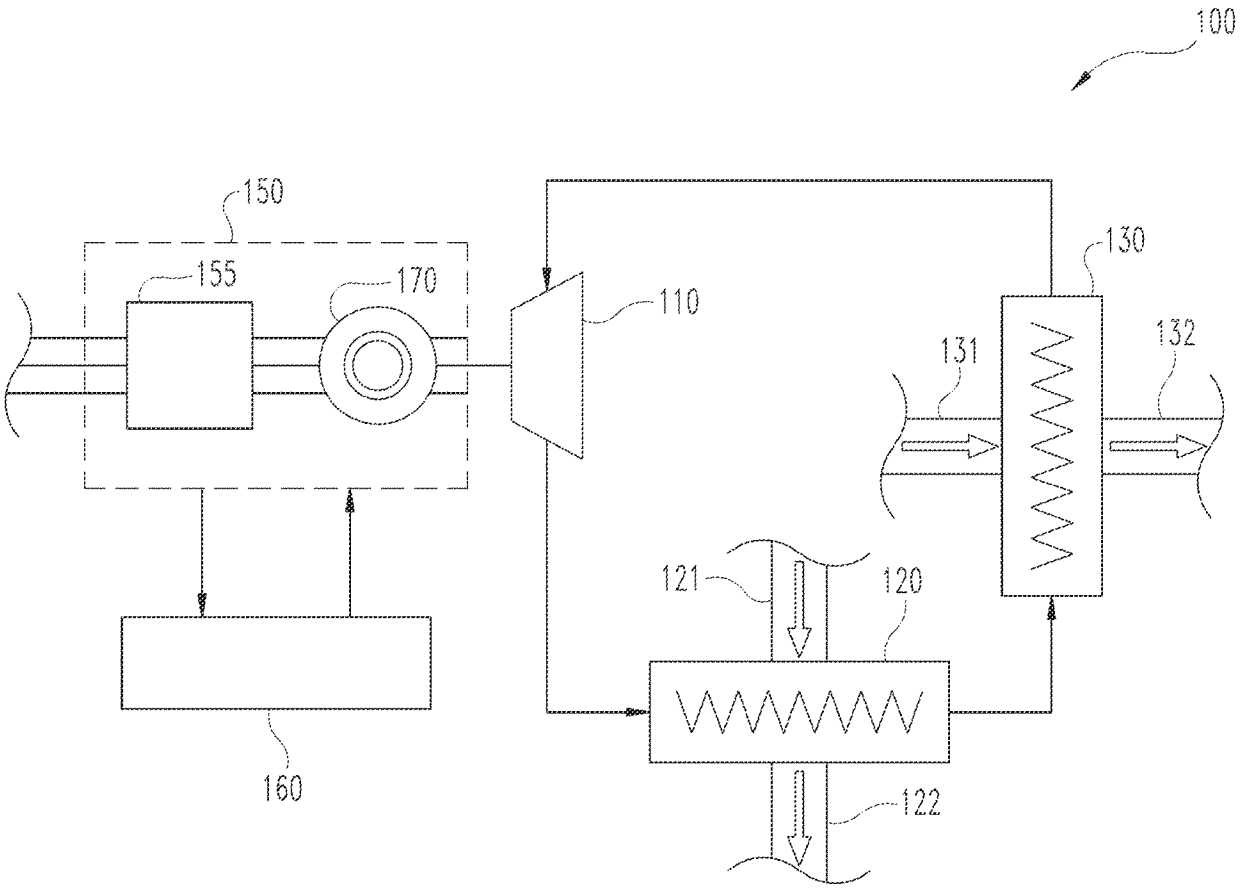
FIG. 1 is a schematic illustration of an exemplary system including a refrigerant compressor.

The detection or determination that a refrigerant compressor is operating or rotating in a reverse direction as disclosed herein may be performed or conducted in connection with a refrigerant compressor used in one of a variety of different applications. By way of non-limiting example, chiller system 100 schematically illustrated in FIG. 1 is one application where detection or determination that a refrigerant compressor is operating or rotating in a reverse direction may be implemented. Chiller system 100 includes a refrigerant loop that includes a compressor 110, a condenser 120, and an evaporator 130. Refrigerant flows through system 100 in a closed loop from compressor 110 to condenser 120 to evaporator 130 and back to compressor 110. Various embodiments may also include additional refrigerant loop elements including, for example, valves for controlling refrigerant flow, refrigerant filters, economizers, oil separators and/or cooling components and flow paths for various system components.

In one form, compressor 110 is a scroll compressor, although other variations are contemplated. Compressor 110 is driven by a drive unit 150 including an electric motor 170 which is driven by a variable frequency drive 155. In one form, variable frequency drive 155 is configured to output a three-phase pulse width modulation (PWM) drive signal, and motor 170 is a surface magnet permanent magnet motor. Use of other types and configurations of variable frequency drives and electric motors such as interior magnet permanent magnet motors, reluctance motors, or inductance motors are also contemplated. It shall be appreciated that the principles and techniques disclosed herein may be applied to a broad variety of drive and permanent magnet motor configurations.

Condenser 120 is configured to transfer heat from compressed refrigerant received from compressor 110. In one form, condenser 120 is a water cooled condenser which receives cooling water at an inlet 121, transfers heat from the refrigerant to the cooling water, and outputs cooling water at an output 122. It is also contemplated that other types of condensers may be utilized, for example, air cooled condensers or evaporative condensers. It shall further be appreciated that references herein to water include water solutions comprising additional constituents unless otherwise limited.

Evaporator 130 is configured to receive refrigerant from condenser 120, expand the received refrigerant to decrease its temperature and transfer heat from a cooled medium to the refrigerant. In one form, evaporator 130 is configured as a water chiller which receives water provided to an inlet 131, transfers heat from the water to the refrigerant, and outputs chilled water at an outlet 132. It is contemplated that a number of particular types of evaporators and chiller systems may be utilized, including dry expansion evaporators, flooded type evaporators, bare tube evaporators, plate surface evaporators, and finned evaporators among others.

Chiller system 100 further includes a controller 160 which outputs control signals to variable frequency drive 155 to control operation of motor 170 and compressor 110. Controller 160 also receives information about the operation of drive unit 150 including, but not limited to, information relating to motor current, motor terminal voltage, motor speed and/or other operational characteristics of motor 170, as well as information about the operation of compressor 110 and other components of system 100, including for example, information related to refrigerant pressure and/or component temperatures amongst other possibilities. It shall be appreciated that the controls, control routines, and control modules described herein may be implemented using hardware, software, firmware and various combinations thereof and may utilize executable instructions stored in a non-transitory computer readable medium or multiple non-transitory computer readable media. It shall further be understood that controller 160 may be provided in various forms and may include a number of hardware and software modules and components such as those disclosed herein.

Figure 2:
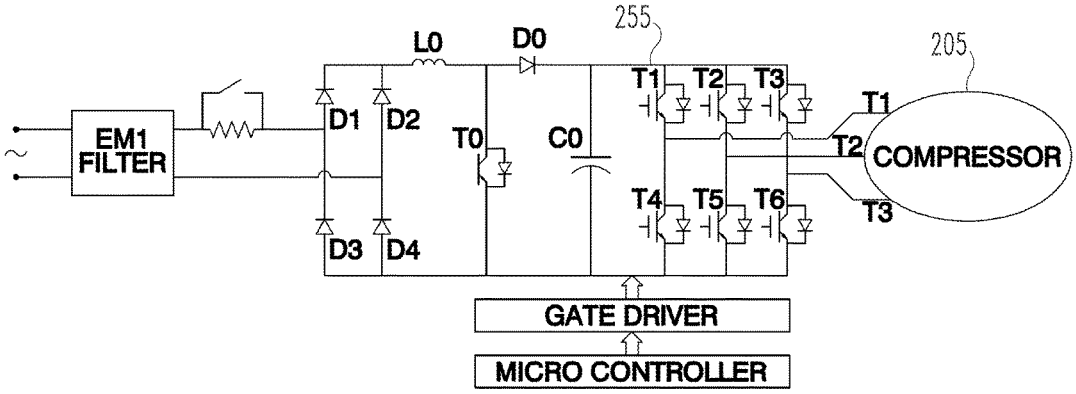
FIG. 2 is an electrical schematic of the variable frequency drive and compressor of the system of FIG. 1.

As indicated above, a variety of conditions may cause compressor 110 to operate or rotate in a reverse direction where, for example, compressor 110 will move or attempt to move refrigerant from the direction of condenser 120 toward evaporator 130. For example, in the event of mis-wiring between VFD 155 and compressor 110, compressor 110 will operate in reverse. As illustrated in the form of FIG. 2 for example, variable frequency drive 155 includes outputs T1, T2 and T3 which must be properly matched with outputs Tc1, Tc2, Tc3 (not shown) of compressor 110 in order for compressor 110 to operate in a normal or forward direction (i.e., where refrigerant will be moved from the direction of evaporator 130 toward condenser 120). In the event these outputs are not matched properly, compressor 110 will operate or rotate in a reverse direction. Tables 1 and 2 below provide examples of combinations of connections between outputs T1-T3 and Tc1-Tc3 that will result in normal and reverse operation of compressor 110.

TABLE 1

Normal Operation Connection Combinations

| | VFD | Compressor |
|---|---|---|
| Combination 1 | T1 | Tc1 |
| | T2 | Tc2 |
| | T3 | Tc3 |
| Combination 2 | T1 | Tc2 |
| | T2 | Tc3 |
| | T3 | Tc1 |
| Combination 3 | T1 | Tc3 |
| | T2 | Tc1 |
| | T3 | Tc2 |

TABLE 2

Reverse Running Connection Combinations

| | VFD | Compressor |
|---|---|---|
| Combination 1 | T1 | Tc1 |
| | T2 | Tc3 |
| | T3 | Tc2 |

TABLE 2-continued

Reverse Running Connection Combinations

| | VFD | Compressor |
|---|---|---|
| Combination 2 | T1 | Tc2 |
| | T2 | Tc1 |
| | T3 | Tc3 |
| Combination 3 | T1 | Tc3 |
| | T2 | Tc2 |
| | T3 | Tc1 |

Figure 3:
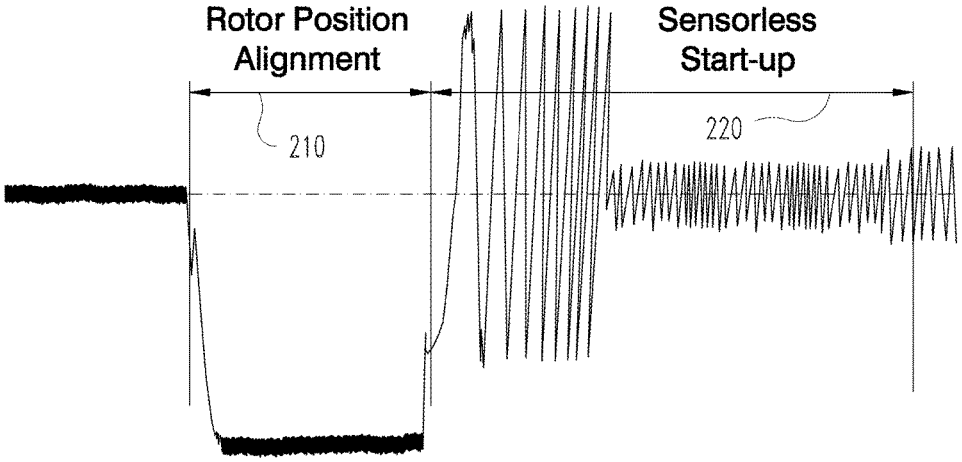
FIG. 3 is a graphical illustration representative of a start-up procedure for the variable frequency drive.
Figure 4:
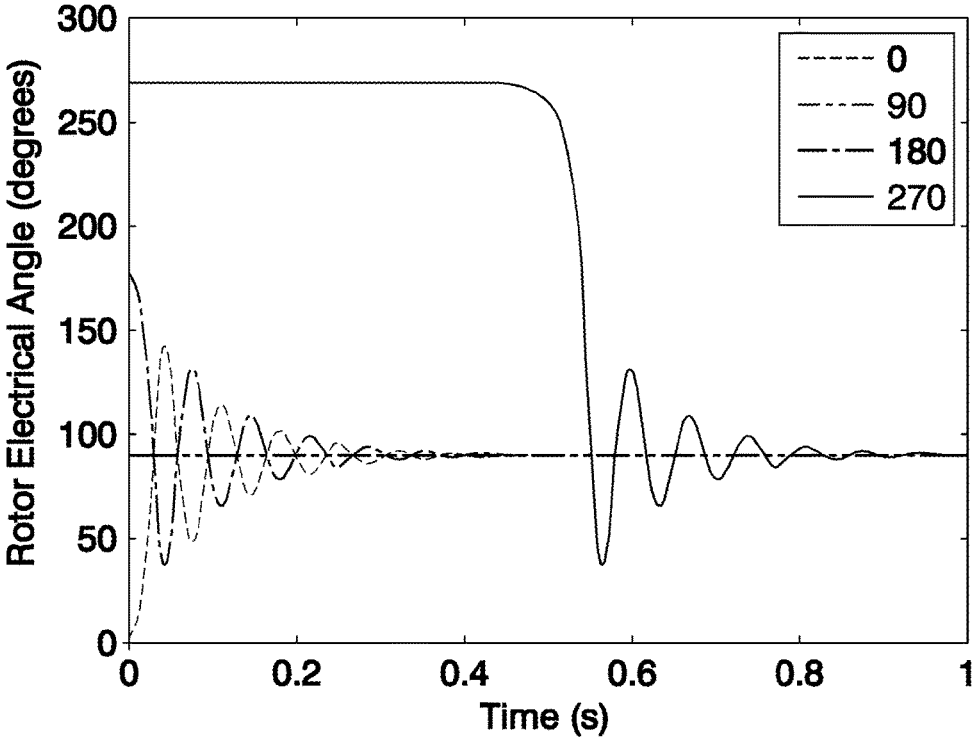
FIG. 4 is a graphical illustration representative of rotor alignment of the variable frequency drive.

Compressor 110 may also operate in reverse in response to failure of a start-up algorithm. For example, in forms where motor 170 does not include a speed transducer, VFD 155 will employ sensorless speed control in which case it must determine its initial rotor position at start-up in order to provide maximum start-up torque. In order to determine initial rotor position, VFD operates a rotor alignment procedure 210 before a sensorless start-up procedure 220 as shown in FIG. 3. During procedure 210, a DC current is injected into motor A phase winding and output from B and C phase windings. In this case, the initial rotor angle should be 90 electrical degrees. However, the effect of rotor alignment depends on the initial rotor position which is shown in FIG. 4. The illustration of FIG. 4 is based on simulation results which assume discharge and suction pressure are equal with very low friction. As illustrated in FIG. 4, alignment performance is the worst when rotor angle is around 270 degree. Therefore, if there is a pressure difference, or larger friction occurs, the alignment could fail. If the angle between the target aligned angle and actual angle is larger than 180 electrical degrees, then compressor 110 will operate in reverse.

Figure 5:
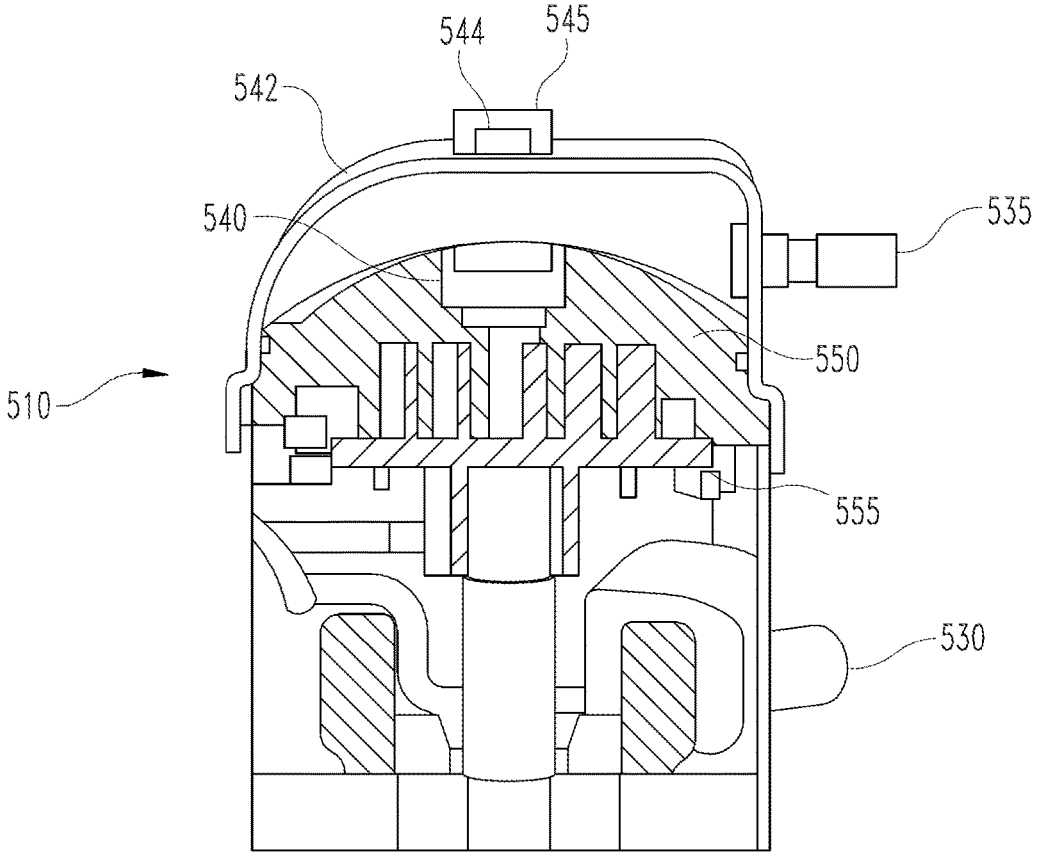
FIG. 5 is a partial section view of a scroll compressor.

Turning now to FIG. 5, further details regarding compressor 110 in the form of a scroll compressor will be provided. It should be understood that other variations in the scroll compressor design for compressor 110 beyond those discussed herein are possible. Compressor 110 includes a fixed scroll 250 and a moving scroll 255. Compressor 110 also includes, as associated with normal operation of compressor 110, a suction line or refrigerant inlet 230 and a discharge line or refrigerant outlet 235. Compressor 110 also includes an internally positioned check valve 240 configured to prevent refrigerant from flowing from outlet 235 to inlet 230. While not illustrated, compressor 110 also includes one or more sensors positioned near or associated with inlet 230 and outlet 235 and configured to measure pressure of the refrigerant at or near inlet 230 and 235. These pressure sensors may be configured such that they are capable of reporting out the absolute pressure of the refrigerant at inlet 230 and outlet 235 continually during start-up and running operation. These sensors may also be configured to transmit measured pressure values to controller 160. In addition to various pressure sensors, compressor 110 also includes a temperature sensor 244 positioned on an external surface of housing or dome 242 of compressor 110. Sensor 244 is surrounded or shielded by an insulating member 245 configured to protect sensor 244 from influences attributable to ambient air. Sensor 244 is configured to measure temperature of dome 242 and provided measured temperature values to controller 160.

Figure 6:
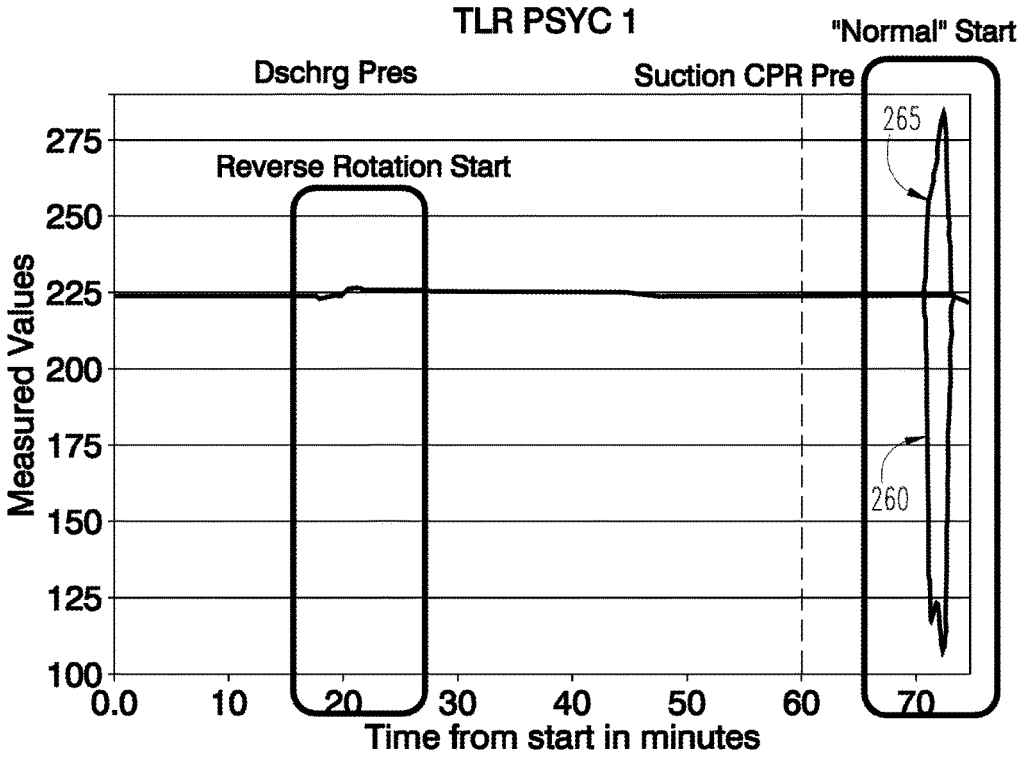
FIG. 6 is a graphical illustration representative of discharge and suction pressure at normal and reverse rotation starts of the compressor of FIG. 5.

Controller 160 is configured to determine compressor 110 is operating or rotating in a reverse direction utilizing one or more of the approaches discussed below in connection with FIGS. 6-11. Under one approach, controller 160 is configured to determine that compressor 110 is operating or rotating in a reverse direction if refrigerant pressure at inlet 230 remains constant for a predefined period of time following start-up of compressor 110. Turning to FIG. 6 for example where pressure values are provided in psig, during a normal start-up of compressor 110 (i.e., where compressor 110 does not operate or rotate in a reverse direction) refrigerant pressure 260 at inlet 230 sharply decreases and refrigerant pressure 265 at outlet 235 sharply increases as a function of time during normal start-up.

In contrast, refrigerant pressures at inlet 230 and outlet 235 respond significantly differently if compressor 110 rotates reversely at start-up. During a reverse rotation start-up it would be expected that pressure would be developed at inlet 230 instead of outlet 235, which would result in a pressure increase at inlet 230 and a decrease at outlet 235. As shown in FIG. 6 however, refrigerant pressure measured at each of inlet 230 and outlet 235 is relatively unresponsive to the reverse rotation start-up. This unresponsiveness may be attributed to the response and location of check valve 240 since refrigerant flow between outlet 235 and scrolls 250, 255 is prevented. As a result, no pressure difference will occur at outlet 235. Further, since check valve 240 prevents refrigerant flow from outlet 235 into scrolls 250, 255, only the volume of refrigerant trapped in compressor 110 downstream of check valve 240 and the scroll will be moved to inlet 230. This small mass of refrigerant as well as the relatively large volume of the suction-side of compressor 110 will result in no measurable increase in the pressure of refrigerant at outlet 230. In addition to or in lieu of determining that compressor 110 is operating or rotating in a reverse direction if refrigerant pressure at inlet 230 remains constant for a predefined period of time following start-up of compressor 110, controller 160 may be configured to determine that compressor 110 is operating or rotating in a reverse direction if there is no measured refrigerant pressure increase or decrease at outlet 235 for a predetermined period of time following starting of compressor 110, or if the ratio between refrigerant pressure at inlet 230 and outlet 235 remains the same for a predetermined period of time following starting of compressor 110.

In addition to or in lieu of the approaches described in connection with FIG. 6, controller 160 may be configured to determine that compressor 110 is operating or rotating in a reverse direction if the frequency of pressure oscillations of the refrigerant at inlet 230 exceeds a predetermined threshold. For example, it has been surprisingly observed that during reverse rotation or operation of compressor 110 the pressure measured at inlet 230 will exhibit higher frequency oscillations than during normal operation of compressor 110. Similarly, the level of frequency oscillations in the refrigerant pressure measured at inlet 230 during normal operation of compressor 110 may serve as a baseline or threshold above which frequency oscillations in the refrigerant pressure measured at inlet 230 can be attributed to compressor 110 rotating or operating in a reverse direction.

Figure 7:
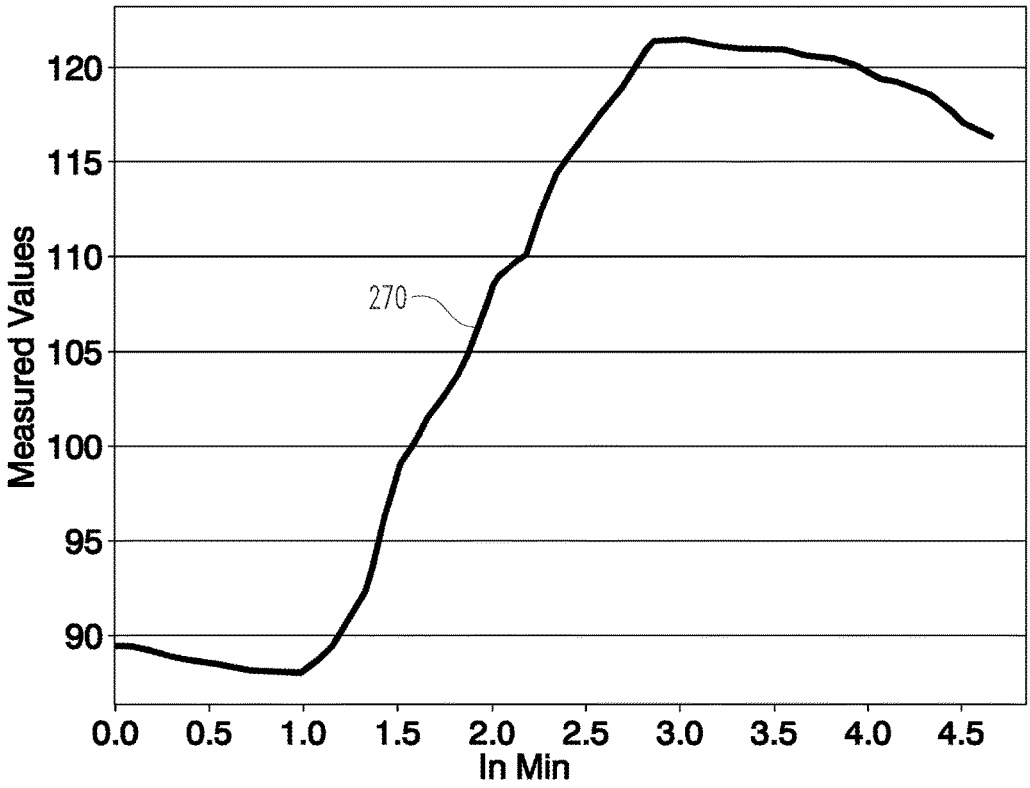
FIG. 7 is a graphical illustration representative of compressor dome temperatures during a normal start.
Figure 8:
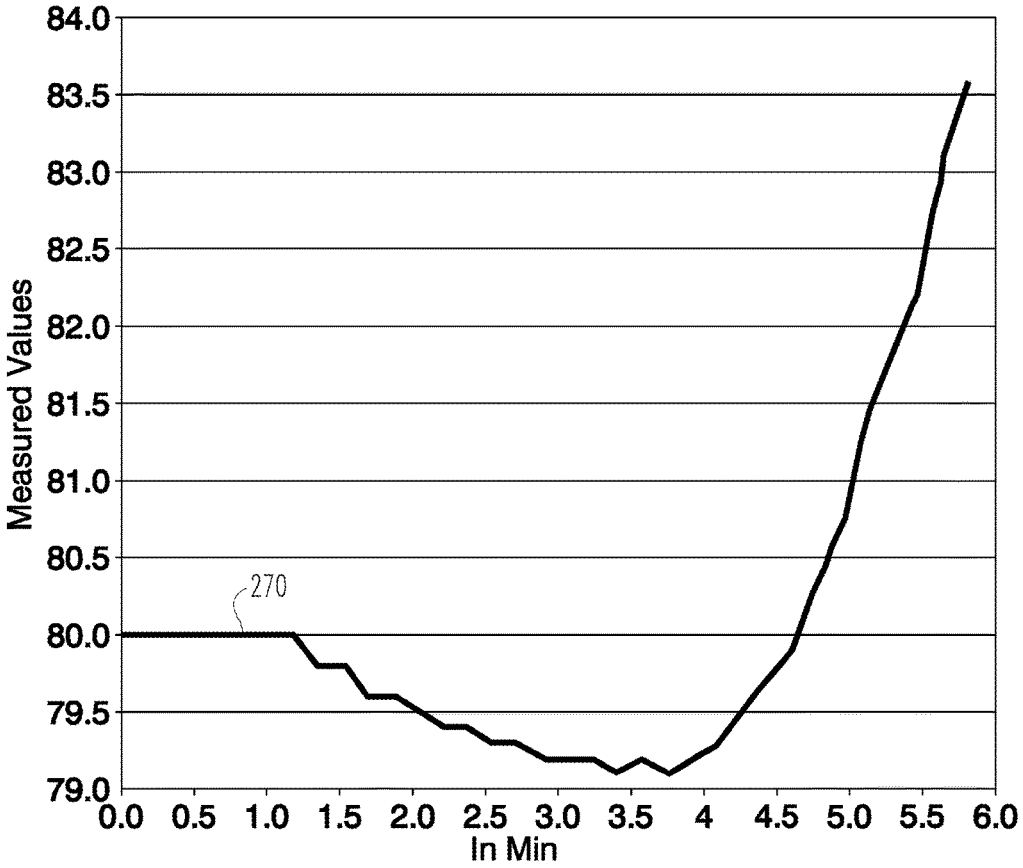
FIG. 8 is a graphical illustration representative of compressor dome temperatures during a reverse rotation start.

In another approach, controller 160 is configured to determine that compressor 110 is operating or rotating in a reverse direction if a temperature of dome 242 fails to exceed a predetermined threshold at or before expiration of a first predetermined period of time following starting of compressor 110. Turning to FIG. 7 for example, during a normal start-up of compressor 110 (i.e., where compressor 110 does not operate or rotate in a reverse direction), temperature 270 of dome 242 beings to increase after about one minute following start-up of compressor 110 and then gradually increases at a rate of approximately 15° F. per minute for approximately the next two minutes. In contrast, FIG. 8 illustrates that temperature 270 of dome 242 decreases for several minutes following start-up of compressor 110 if compressor 110 rotates reversely at start-up. The decrease in the temperature of dome 242 in FIG. 8 may be attributed to, amongst other things, a significant reduction in heat transfer between the compressor motor and dome 242 and dome temperature being decoupled from motor temperature when compressor 110 operates or rotates in a reverse direction. In contrast, during a normal start of compressor 110, temperatures of dome 242 increase as the flow and density of refrigerant vapor at outlet 235 become higher. Based on the foregoing, it should be understood that failure of temperature 270 of dome 242 to exceed a predetermined threshold before expiration of a predetermined period of time following starting of compressor 110 may be associated with reverse rotation or operation of compressor 110. By way of non-limiting example, the predetermined threshold and predetermined period of time may be based on the temperature profile of dome 242 during normal start-up of compressor 110. Further, the rate of increase associated with temperature 270 of dome 242 during normal start-up may also be used as a basis for determining that compressor 110 is operating or rotating in a reverse direction. For example, controller 160 may be configured to determine compressor 110 is operating or rotating in a reverse direction if the rate of increase associated with temperature 270 falls below a predetermined rate of increase before expiration of a predetermined period of time following starting of compressor 110. By way of non-limiting example, the predetermined rate of increase may correspond to the rate of increase of temperature 270 during normal start-up of compressor and the predetermined period of time may correspond to the point at which temperature 270 in FIG. 7 stops increasing.

In another approach, controller 160 is configured to analyze a waveform associated with motor current, motor torque, or refrigerant pressure in connection with determining if compressor 110 is operating or rotating in a reverse direction. The details provided in connection with this approach were developed by analyzing various operating characteristics of a three ton compressor. The parameters of this compressor are shown in Table 3.

TABLE 3

| Parameters | Value |
|---|---|
| $L_q$ | 4.96 mH |
| $L_d$ | 3.9 mH |
| P | 3 |
| $r_s$ | 0.13 ohm |
| $K_E$ (Induced voltage constant) | 42.4 $V_{L-L,\ rms}$/krpm |
| $K_T$ (Motor torque constant) | 0.5 Nm/Arms |
| Max Torque | 15 Nm |

Equations related to operation of this compressor are provided below:

$$V_{qs}^r = r_s I_{qs}^r + w_r L_d I_{ds}^r + w_r \lambda_m' \tag{1}$$

$$V_{ds}^r = r_s I_{ds}^r - w_r L_q I_{qs}^r \tag{2}$$

$$T_e = \left(\frac{3}{2}\right) P[\lambda_m' I_{qs}^r + (L_d - L_q) I_{qs}^r I_{ds}^r] \tag{3}$$

$$i_{ds}^{r*} = \frac{T_e}{\frac{3}{2} P (L_d - L_q) i_{qs}^{r*}} - \frac{\lambda_m'}{L_d - L_q} \tag{4}$$

-continued $$i_s = \sqrt{\frac{(i_{ds}^{r*})^2 + (i_{qs}^{r*})^2}{2}} \tag{5}$$

$$(i_{ds}^{r*})^4 + \frac{T_e}{\frac{3}{2}P(L_d - L_q)^2} - \left(\frac{T_e}{\frac{3}{2}P(L_d - L_q)}\right)^2 = 0 \tag{6}$$

Figure 9:
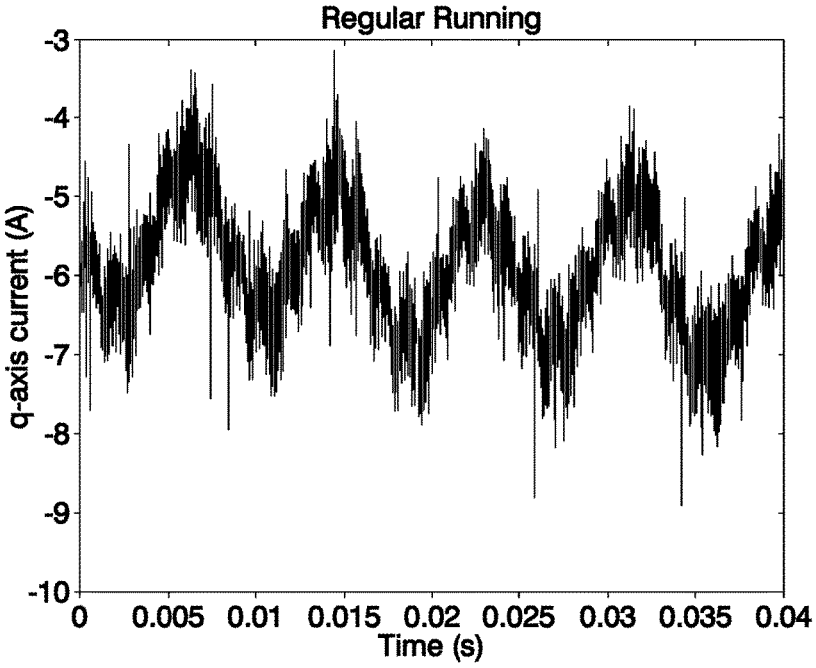
FIG. 9 is a waveform representative of q-axis current during regular operation of a compressor.
Figure 10:
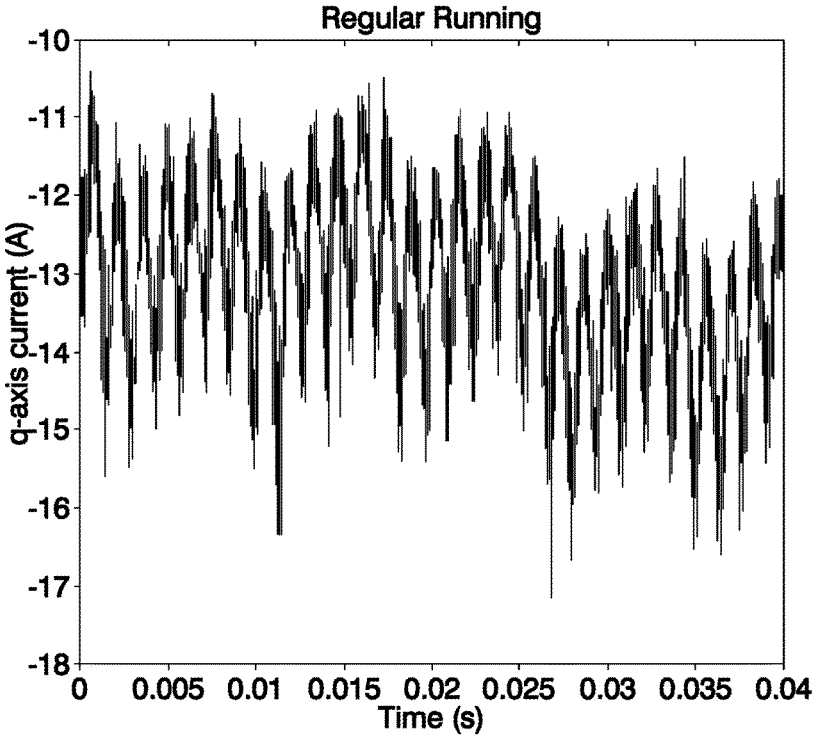
FIG. 10 is a waveform representative of q-axis current during reverse rotation operation of a compressor.

The terms of the equations above have the following meanings:

$I_{qs}^r$: q-axis current in rotor reference frame
$I_{ds}^r$: d-axis current in rotor reference frame
$L_q$: q-axis inductance
$L_d$: d-axis inductance
$T_e$: electrical torque
$\lambda'_m$: back-emf constant
P: pair of poles
$r_s$: winding resistance P-N
$w_r$: electrical speed in rad/s D-axis current is normally relatively small, so motor torque and q-axis current are typically proportionate to one another. A waveform of Q-axis current during normal and reverse rotation operation of the compressor are shown in FIGS. 9 and 10, respectively. In these figures, q-axis current fundamental amplitude does not reflect real data because rotor angle is not properly factored. From q-axis current analysis, it has been determined that the motor torque waveform will be the same as q-axis current waveform. In addition, the refrigerant pressure waveform at outlet 235 will be similar to the q-axis and torque waveforms. During normal operation of the compressor, the pressure and torque waveforms are changed based on resolution. During reverse operation or rotation of the compressor (except oscillation based on resolution), one or more high frequency harmonics will be present on the motor current and torque waveforms and result from friction and the structure of the scroll compressor. The one or more high frequency harmonics may lead to audible noise.

Figure 11:
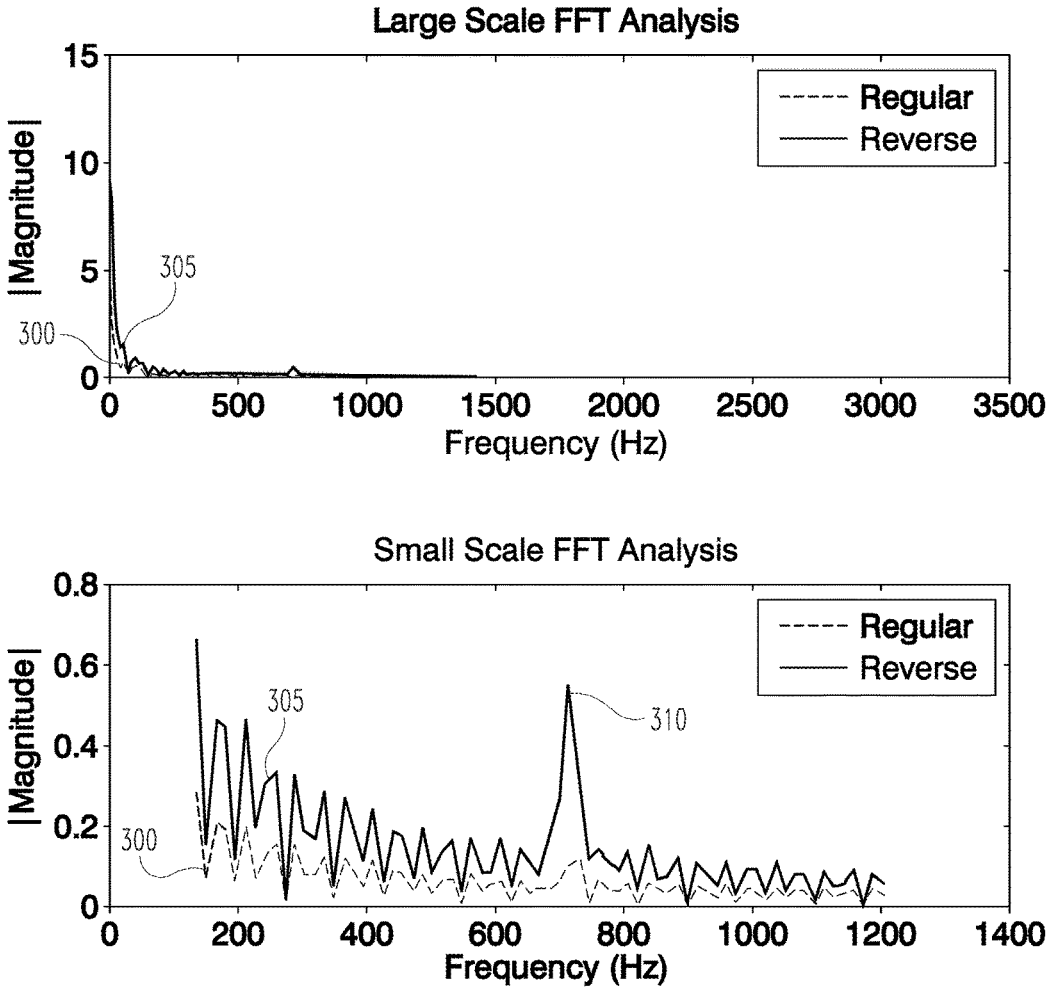
FIG. 11 includes graphical illustrations representative of large and small scale FFT analysis of q-axis current waveforms for regular and reverse rotation operation of a compressor.

Based on the above, it should be understood that waveform analysis may be performed to determine the compressor is running or operating in a reverse direction. One non-limiting type of waveform analysis that may be conducted is a fast Fourier transform (FFT) analysis. FIG. 11 provides graphical illustrations representative of large and small scale FFT analysis of q-axis current waveforms for normal or regular rotation 300 and reverse rotation 305 operation of the compressor. As illustrated in FIG. 11, a high frequency harmonic 310 is present on waveform 305 and allows waveform 305 to be distinguished from waveform 300. Similarly, in one form controller 160 is configured to determine that the compressor is rotating or operating in a reverse direction if a high frequency harmonic exceeding a predetermined threshold is present on the q-axis current waveform or other waveform that is analyzed. The threshold can be selected to diagnose reverse running based on the high frequency harmonic amplitude for example. For different compressors the high frequency harmonic may be different. Accordingly, in addition to or in lieu of the foregoing, controller 160 may be configured to determine the compressor is rotating or operating in a reverse direction by analyzing amplitude within a frequency band. For example, in one form, if the summation of all FFT amplitude within the frequency band is higher than a threshold, then controller 160 determines that the compressor is rotating or operating in a reverse direction. This threshold may be based on regular rotation 300 waveform, and may correspond to or be different from the predetermined threshold used in connection with the presence of one or more high frequency harmonics that exceed a predetermined threshold. FFT analysis may be performed by controller 160 provided it has sufficient current or torque signal sampling frequency. Forms in which one or more controllers are used to perform the analysis associated with FIG. 11 are also possible. For example, a motor oriented controller (MOC) could conduct signal sampling and FFT analysis and then send diagnostic results to an application oriented controller (AOC). As an alternative, the MOC could conduct signal sampling and send the results to the AOC where the FFT analysis is performed.

While not previously discussed, it should be understood that the analysis described in connection with FIG. 11 could also be conducted in connection with a torque waveform since the torque waveform is the same as the q-axis current waveform as indicated above. In addition, since the refrigerant pressure waveform at outlet 235 will be similar to the q-axis and torque waveforms, the analysis described in connection with FIG. 11 could also be performed in connection with the refrigerant pressure waveform at outlet 235.

Controller 160 may be configured to implement only one, more than one, or all of the approaches described herein for determining a compressor is rotating or operating in a reverse direction. Controller 160 may also be configured to take a variety of different actions in response to determining the compressor is operating or rotating in the reverse direction. For example, in one form controller 160 is configured to terminate operation of the compressor if it is determined the compressor is rotating or operating in the reverse direction.

In certain embodiments, a controller is described performing certain operations to detect and adjust a heating, ventilation, and air conditioning ("HVAC") system to various operating conditions, or other operations. In certain embodiments, the controller forms a portion of a processing subsystem including one or more computing devices having memory, processing, and communication hardware. The controller may be a single device or a distributed device, and the functions of the controller may be performed by hardware or software.

Certain operations described herein include operations to interpret or determine one or more parameters. Interpreting or determining, as utilized herein, includes receiving values by any method known in the art, including at least receiving values from a datalink or network communication, receiving an electronic signal (e.g., a voltage, frequency, current, or a Pulse-Width Modulation ("PWM") signal) indicative of the value, receiving a software parameter indicative of the value, reading the value from a memory location on a computer readable medium, receiving the value as a run-time parameter by any means known in the art, and/or by receiving a value by which the interpreted parameter can be calculated, and/or by referencing a default value that is interpreted to be the parameter value.

Figure 12:
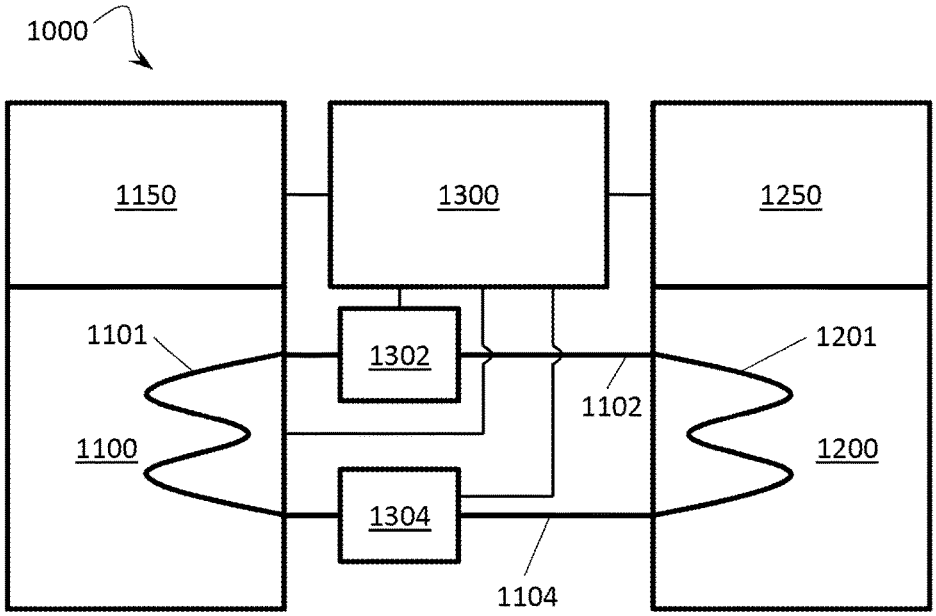
FIG. 12 is a schematic of an embodiment of a HVAC system.

With reference to FIG. 12, an example embodiment of a HVAC system 1000 is shown that can be used, for example, to condition a space in a building or other structure (not shown) and in both heating and cooling modes of operation. System 1000 includes a compressor 1100 for compressing a refrigerant, and may have a first fan 1150 associated therewith. The compressor 1100 and the first fan 1150 may be situated outside of the conditioned space or building. System 1000 may further include an air handling unit 1200 and may have a second fan 1250 associated therewith. The air handling unit 1200 and the second fan 1250 may be situated inside the conditioned space or building. The second fan 1250 may also be in communication to a network of ducts (not shown) extending within and throughout at least a portion of the space or building. The compressor 1100 and air handling unit 1200 may have respective coils 1101,1201 associated therewith. The coils 1101, 1201 are in communication with one another and connected via a low pressure refrigerant line 1102 and a high pressure refrigerant line 1104, with a refrigerant disposed therein. In a cooling mode, the compressor coil 1101 will be a condenser and the air handling unit coil 1201 will be an evaporator. In a heating mode, the compressor coil 1101 will be an evaporator and the air handling unit coil 1201 will be a condenser.

A controller 1300 for monitoring, evaluating, and controlling various aspects of the system 1000 is also provided. The controller 1300 may, for instance, receive inputs of various operational and ambient conditions, process these inputs in accordance with programming instructions encoded on controller 1300, and provide output signals to control the compressor 1100, the first fan 1150, and/or the second fan 1250. In the illustrated embodiment, a first pressure sensor 1302 is located on the low pressure refrigerant line 1102 and a second pressure sensor 1304 is located on the high pressure refrigerant line 1104. The pressure sensors 1302, 1304 may be connected to respective lines 1102, 1104 in any suitable manner so as to effectively measure the pressure of the refrigerant within lines 1102, 1104. The pressure sensors 1302, 1304 are in operative communication with the controller 1300 so as to be capable of sending a signal 1306, 1308, respectively (see FIG. 13), to the controller 1300 that indicates the measured pressures. The controller 1300, in turn, receives and evaluates the pressure signals 1306, 1308 constantly or intermittently, such as every few seconds or minutes. The pressure sensors 1302, 1304 may be of any known kind known in the art suitable for measurement of refrigerant pressure and to communicate with a controller. Such examples may include, a piezoresistive strain gauge sensor, a capacitive sensor, an electromagnetic sensor, or a piezoelectric sensor, just to name a few.

Figure 13:
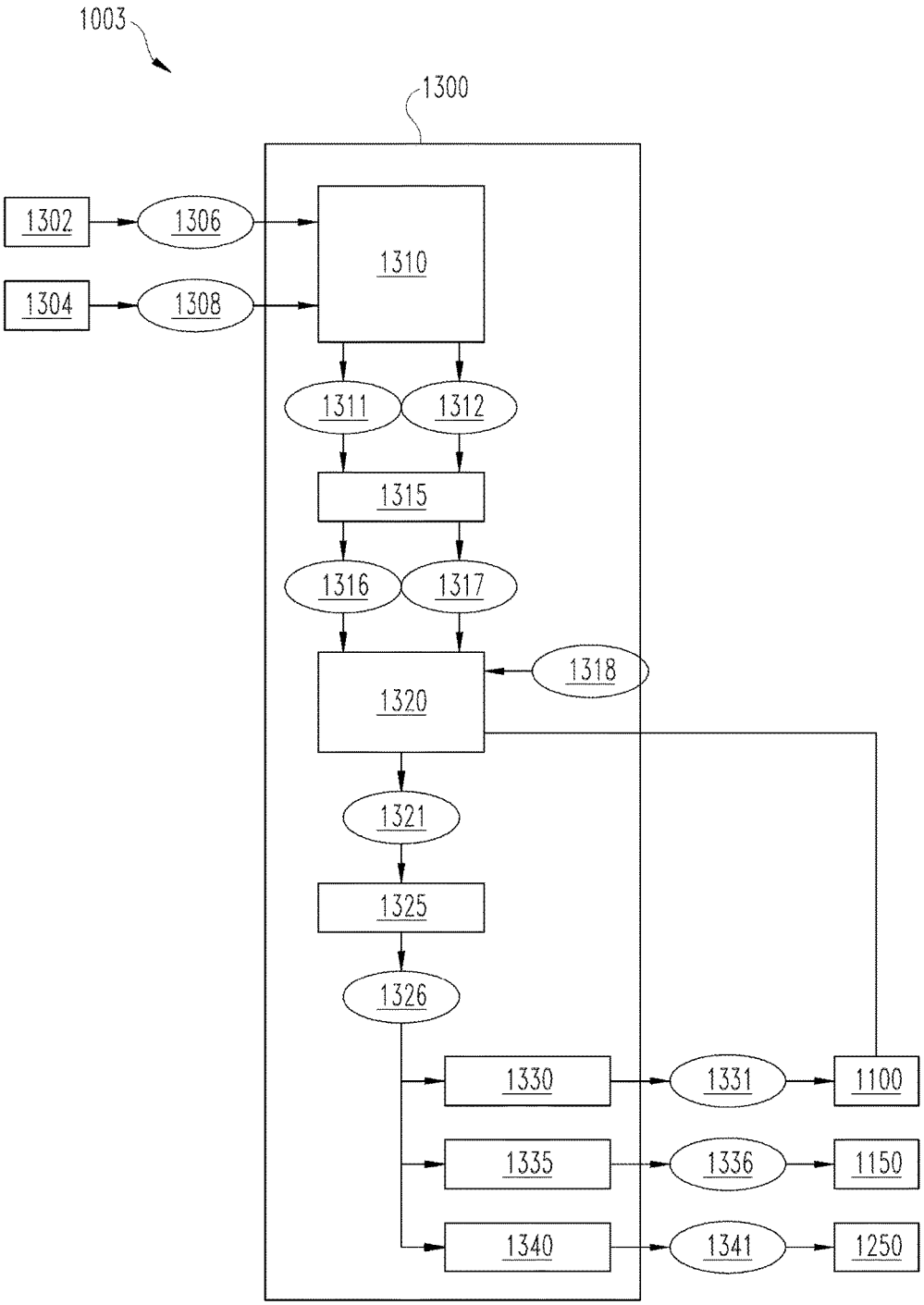
FIG. 13 is a schematic illustration of an example embodiment of a controller apparatus for operating the HVAC system of FIG. 12.

Referring now to FIG. 13, the embodiment of the controller 1300 of the HVAC system 1000 is schematically shown with more detail. The controller 1300 is provided with several modules 1310, 1315, 1320, 1325, 1330, 1335, 1340, each of which may be structured to perform specific tasks. The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on computer readable medium, and modules may be distributed across various hardware or software components.

The controller 1300 may be provided with a pressure sensor processing module 1310 that is structured to receive a first signal 1306 from the first pressure sensor 1302, and a second signal 1308 from the second pressure sensor 1304. From these signals 1306, 1308, the pressure sensor processing module 1310 detects and determines a first pressure value 1311 associated with the low pressure refrigerant line 1102, and a second pressure value 1312 associated with the high pressure refrigerant line 1104.

The controller 1300 may also be provided with a temperature processing module 1315 that is structured to determine a saturated evaporating temperature 1316 of the refrigerant, and a saturated condensing temperature 1317 of the refrigerant in response to the first and second pressure values 1311, 1312.

An operating module 1320 is provided and structured to determine an operating zone value 1321 in response to the determined saturated evaporating temperature 1316, and the saturated condensing temperature 1317.

Figure 14:
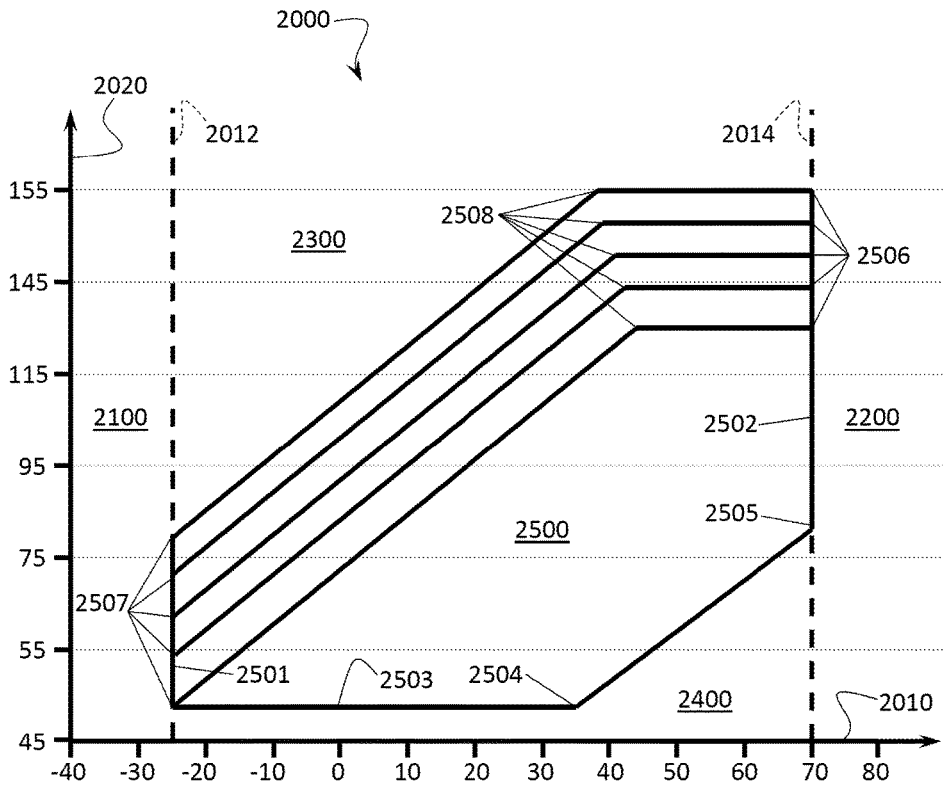
FIG. 14 is a graph showing various compressor operating parameters as a function of saturated evaporating temperatures and saturated condensing temperatures that are considered in determining a compressor operating envelope and the surrounding action zones.

Referring further to FIG. 14, the operating module 1320 also considers one or more of a variety of other parameters 1318 that form an operating map 2000 that defines an envelope 2500 of predefined valid operating parameters within which to operate HVAC system 1000. The operating parameters define a valid operating envelope determined by minimum and maximum saturated evaporating temperature values and upper and lower saturated condensing temperature values that are defined over the range of predefined saturated evaporating temperature values.

These operating parameters 1318 may include but are not necessarily limited to: 1) a minimum saturated evaporating temperature value 2501; 2) a maximum saturated evaporating temperature value 2502; 3) a minimum saturated condensing temperature value 2503 over a range of saturated evaporating temperature values; 4) a maximum saturated condensing temperature 2504 at the minimum saturated evaporating temperature value 2501; 5) a minimum saturated condensing temperature 2505 at the maximum saturated evaporating temperature value 2502; 6) a maximum saturated condensing temperature 2506 as a function of various compressor speeds at the maximum saturated evaporating temperature value 2502; 7) a maximum saturated condensing temperature 2507 as a function of various compressor speeds at the minimum saturated evaporating temperature value 2501; and 8) a maximum saturated condensing temperature 2508 as a function of various compressor speeds at various saturated evaporating temperature transition values.

The operating zone value 1321 determines the zone of operation of the HVAC system 1000. For instance, with further reference to FIGS. 15 and 16 and operating maps 3000 and 4000 shown therein, there may be a first action zone 2100, 3100, 4100, a second action zone 2200, 3200, 4200, a third action zone 2300, 3300, 4300, a fourth action zone 2400, 3400, 4400, and a valid operating envelope 2500, 3500, 4500. When the operating zone value 1321 lies within one of the actions zones, a unique action can be taken to bring compressor 1100 of the HVAC system 1000 into the valid operating envelope 2500, 3500, 4500. These action zones and actions are discussed in greater detail herein, and also depend upon the mode of operation of the system 1000, whether cooling or heating.

Referring back to FIG. 13, an action module 1325 is provided and may be structured to determine an operating action value 1326 in response to the operating zone value 1321. The operating action value 1326 is determined by the action zone in which the system 1000 is operating, which is indicated by the operating zone value 1321. The action module 1325 may also be structured to interpret and/or determine the operating mode in which the system is operating, such as a cooling mode or a heating mode. As will be discussed in greater detail in reference to FIGS. 15 and 16, the action taken to position system 1000 in a valid operating envelope depends on whether the system 1000 is in a cooling or heating mode.

The controller 1300 further includes a compressor control module 1330 that is structured to determine and send a compressor control signal 1331 to the compressor 1100 in response to the operating action value 1326. The compressor control module 1330 may also be structured to interpret and/or determine the speed at which the compressor 1100 is operating. The compressor control signal 1331 can signal to the compressor 1100 to speed up, slow down, including shutting down, or proceed without change. The compressor control signal 1331 may be determined in response to the interpreted and/or determined speed of the compressor 1100 to control how much the compressor speed is changed, if at all.

The controller 1300 also includes a first fan control module 1335 that is structured to determine and send a first fan control signal 1336 to the first fan 1150 in response to the operating action value 1326. The first fan control module 1335 may also be structured to interpret and/or determine the speed at which the first fan 1150 is operating. The first fan control signal 1336 can signal to the first fan 1150 to speed up, slow down, including shutting down, or proceed without change. The first fan control signal 1336 may be determined in response to the interpreted and/or determined speed of the first fan 1150 to control how much the first fan speed is changed, if at all.

The controller 1300 further includes a second fan control module 1340 that is structured to determine and send a second fan control signal 1341 to the second fan 1250 in response to the operating action value 1326, and. The second fan control module 1340 may also be structured to interpret and/or determine the speed at which the second fan 1250 is operating. The second fan control signal 1341 can signal to the second fan 1250 to speed up, slow down, including shutting down, or proceed without change. The second fan control signal 1341 may be determined in response to the interpreted and/or determined speed of the second fan 1150 to control how much the second fan speed is changed, if at all.

Referring back to FIG. 14, the operating map 2000 details the various parameters considered in developing a valid operating envelope 2500. The x-axis 2010 of the map is representative of the saturated evaporating temperature in terms of degrees Fahrenheit, and the y-axis 2020 is representative of the saturated condensing temperature in terms of degrees Fahrenheit. While FIG. 14 is shown in degrees Fahrenheit, any suitable temperature units may be used, such as Kelvin or degrees Celsius. The operating map 2000 defines valid operating envelope 2500 and four action zones 2100, 2200, 2300, 2400 that lie outside the valid operating envelope 2500. The action to be taken to control operation of system 1000 depends upon what action zone the system 1000 is currently operating in and whether the system 1000 is in a heating or a cooling mode. The valid operating envelope 2500 may be representative of any one or combination of known safe operating parameters at which the compressor will not be damaged; reliable operating parameters at which the compressor will not be over-extended and shorten operating life and reliability; or efficient operating parameters at which the compressor does not excessively utilize power.

Various predefined parameters may be utilized to determine the valid operating envelope 2500. The determination of these parameters is dependent upon the compressor 1100 being used. Using these predefined parameters and relating them to the high side and low side refrigerant line pressures, it is possible to develop an operating map that defines a valid operating envelope 2500. Using measurements of the operating conditions of HVAC system 1000 that determine the saturated evaporating and saturated condensing temperatures, it can be determined if the system is operating outside the boundaries of the valid operating envelope 2500.

These generic parameters may include a minimum saturated evaporating temperature value 2501, which represents a left hand boundary line of the valid operating envelope 2500, and a maximum saturated evaporating temperature value 2502, which represents a right hand boundary line of the of the valid operating envelope 2500. The minimum saturated condensing temperature value 2503 forms a boundary line at the lower portion of the valid operating envelope 2500 over a range of saturated evaporating temperature values that extends to a maximum saturated evaporating temperature 2504 at the minimum saturated condensing temperature value 2503. The lower portion of the boundary of valid operating envelope 2500 is completed by a line that extends from temperature 2504 to a minimum saturated condensing temperature 2505 at the maximum saturated evaporating temperature value 2502. The upper boundary of valid operating envelope 2500 is formed as a function of the compressor speed by a line that extends from the maximum saturated condensing temperature 2507 at the minimum saturated evaporating temperature transition value 2501 to the maximum saturated condensing temperature 2508 as a function of various compressor speeds at various saturated evaporating temperature transition values, and then along the maximum saturated condensing temperature 2506 to the maximum saturated evaporating temperature value 2502.

As shown in FIG. 14, one example of a minimum saturated evaporating temperature value 2501, 2012 is −25° F.; the maximum saturated evaporating temperature value 2502, 2014 is 70° F.; the minimum saturated condensing temperature value 2503 is 40° F.; the maximum saturated evaporating temperature value 2504 is 35° F.; the minimum saturated condensing temperature value 2505 is 80° F.; and the maximum saturated condensing temperature values 2506, 2507 and 2508 vary as a function of compressor speed. Other temperatures values for one or more of these operating parameters are also contemplated. It is further appreciated that other temperature units are also suitable.

Operating map 2000 defines four action zones 2100, 2200, 2300, 2400 that lie outside the valid operating envelope 2500. The first action zone 2100 is defined as any point on the operating map 2000 that is below the minimum saturated evaporating temperature 2012. The second action zone 2200 is defined as any point on the operating map 2000 that is above the maximum saturated evaporating temperature 2014. The third action zone 2300 is defined as any point on the operating map 2000 that is between the minimum and maximum saturated evaporating temperatures 2012, 2014, and has a saturated condensing temperature above the upper boundary of valid operating envelope 2500. The fourth action zone 2400 is defined as any point on the operating map that is between the minimum and maximum saturated evaporating temperatures 2012, 2014, and has a saturated condensing temperature below the lower boundary valid operating envelope 2500.

Figure 15:
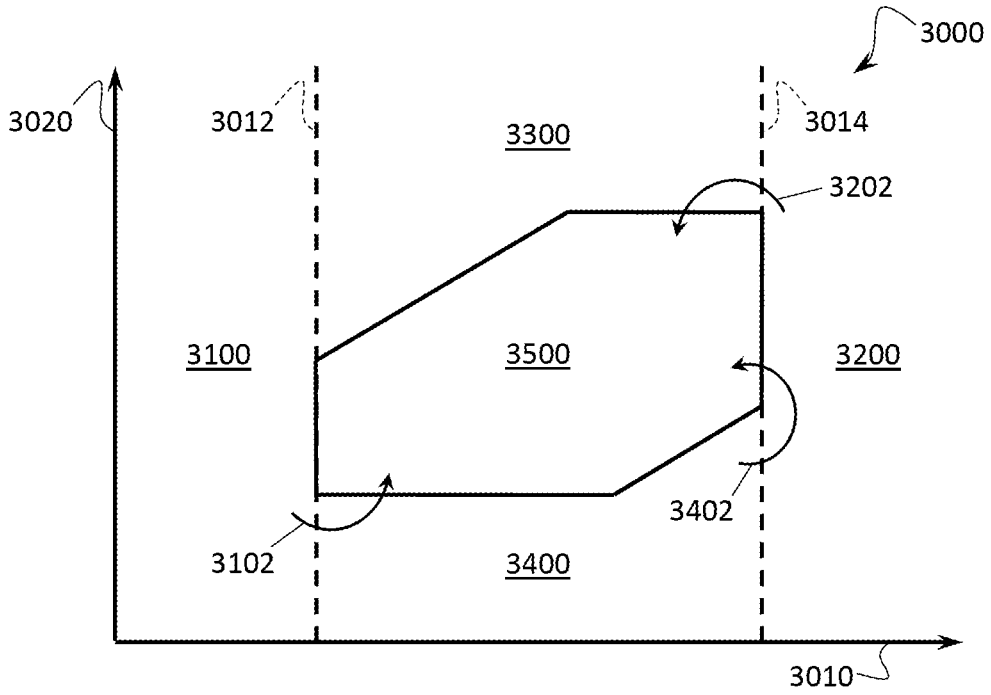
FIG. 15 is an example operating map for an embodiment of a compressor system operating in a cooling mode.

With reference to FIG. 15, an example operating map 3000 for a HVAC system 1000 operating in a cooling mode is provided. Similar to FIG. 14, the operating map 3000 is divided into four action zones 3100, 3200, 3300, 3400 and a valid operating envelope 3500. The x-axis 3010 and y-axis 3020 represent a range of saturated evaporating temperatures and a range of saturated condensing temperatures, respectively. Further, the minimum saturated evaporating temperature boundary line 3012 and the maximum saturated evaporating temperature boundary line 3014 are provided to delineate the four action zones 3100, 3200, 3300, 3400. The following discussion will now proceed with additional reference to FIGS. 12 and 13 in addition to FIG. 15. In operation, the controller 1300 is continuously or periodically receiving input of operating conditions of system 1000 and determining operating zone values 1321 that define the operating zone in which the system 1000 is operating, initiating actions when appropriate to move operation of system 1000 into the valid operating envelope 3500.

When the system 1000 and compressor 1100 are operating in the valid operating envelope 3500 no action needs to be taken to change the operation of the system 1000. When the system 1000 is operating in the first action zone 3100, the controller's compressor control module 1330 sends a signal 1331 to the compressor 1100 to slow down. When the system 1000 is operating in the second action zone 3200, the controller's second fan control module 1340 sends a signal 1341 to the second fan 1250, the fan associated with the air handling unit 1200, to slow down. When the system 1000 is operating in the third action zone 3300, the controller's compressor control module 1330 sends a signal 1331 to the compressor 1100 to slow down. When the system 1000 is operating in the fourth action zone 3400, the controller's first fan control module 1335 sends a signal 1336 to the first fan 1150, the fan associated with the compressor 1100, to slow down.

It is possible for the action taken by the controller 1300 to move the system 1000 from one action zone to another action zone before the system 1000 finds itself in the valid operating envelope 3500. For instance, the system 1000 may take transitional actions 3102, 3202, 3402 from one zone to another before settling in the valid operating envelope 3500. As an example, the system 1000 may start in the first action zone 3100 causing the compressor 1100 to be slowed down. This action may result in the system 1000 moving to the fourth action zone 3400, in which no change to the compressor's operation will take place, but the first fan 1150 will then be directed to slow down, moving the system 1000 from the fourth action zone 3400 to the valid operating envelope 3500. This transition is indicated by curved arrow 3102 in FIG. 15. Similarly, the system 1000 may start the second action zone 3200 and move to the third action zone 3300 before settling in the valid operating envelope 3500. This transition is indicated by curved arrow 3202 in FIG. 15. In addition, the system 1000 may start the fourth action zone 3400, move to the second action zone 3200, then transition into the valid operating envelope 3500. This transition is indicated by curved arrow 3402 in FIG. 15. It is appreciated that the arrows representing the transition actions 3102, 3202, 3402 do not necessary represent exact operating points on the operating map 3000, but do generally describe the movement between zones through which the system 1000 may transition. It is also appreciated that while a few multiple zone transitions have been described for a cooling mode, these are not exhaustive as to the possible transitions the system 1000 may take from one zone to another.

Figure 16:
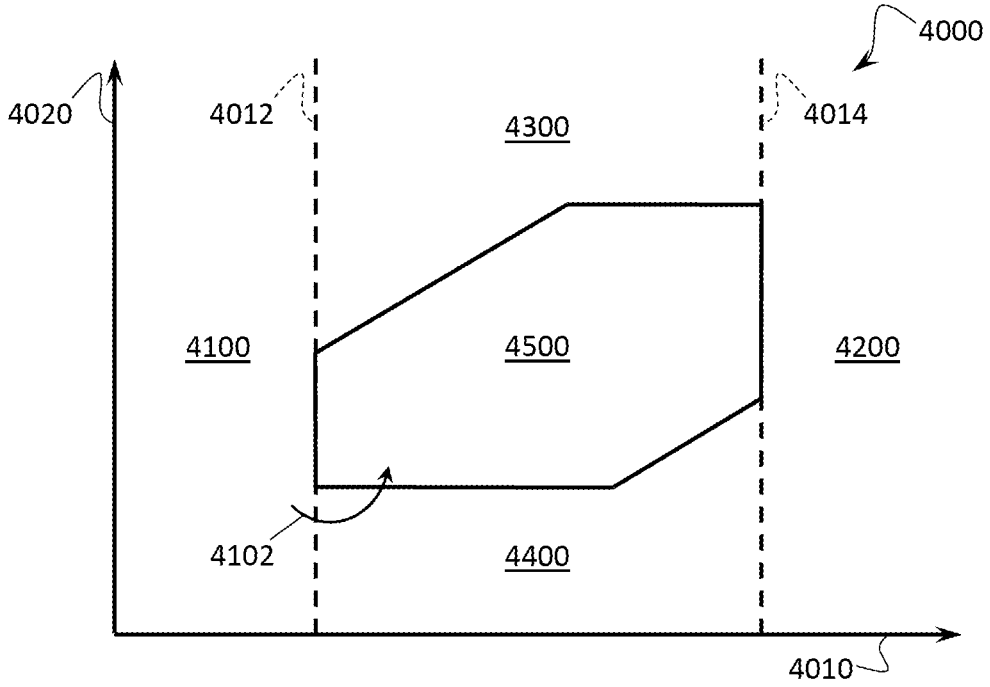
FIG. 16 is an example operating map for an embodiment of a compressor system operating in a heating mode.

Referring to FIG. 16, an example operating map 4000 for a HVAC system 1000 operating in a heating mode is provided. Similar to FIGS. 14 and 15, the operating map 4000 is divided into four action zones 4100, 4200, 4300, 4400 and a valid operating envelope 4500. The x-axis 4010 and y-axis 4020 represent a range of saturated evaporating temperatures and a range of saturated condensing temperatures, respectively. Further, the minimum saturated evaporating temperature boundary line 4012 and the maximum saturated evaporating temperature boundary line 4014 are provided to delineate the four action zones 4100, 4200, 4300, 4400. The following discussion will now proceed with additional reference to FIGS. 12 and 13 in addition to FIG. 16. In operation, the controller 1300 is continuously or periodically evaluating the system 1000 and determining operating zone values 1321 that define the operating zone in which the system 1000 is operating, initiating actions when appropriate to move operation of system 1000 into valid operating envelope 4500.

When the system 1000 and compressor 1100 are operating in the valid operating envelope 4500 no action needs to be taken to change the operation of the system 1000. When the system 1000 is operating in the first action zone 4100, the controller's compressor control module 1330 sends a signal 1331 to the compressor 1100 to slow down. When the system 1000 is operating in the second action zone 4200, the controller's compressor control module 1330, first fan control module 1335, and second fan control module 1340 send signals 1331, 1336, 1340 to the compressor 1100, first fan 1150, and second fan, respectively, to shut down. When the system 1000 is operating in the third action zone 4300, the controller's compressor control module 1330 sends a signal 1331 to the compressor 1100 to slow down. When the system 1000 is operating in the fourth action zone 4400, the controller's second fan control module 1340 sends a signal 1341 to the second 1250, the fan associated with the air handling unit 1200, to slow down.

Similar to the cooling mode as shown in FIG. 15, it is possible for the action taken by the controller 1300 to move the system from one action zone to another in the heating mode before the system finds itself in the valid operating envelope 4500. For instance, the system 1000 may take a transitional action 4102 from the first action zone 4100 to the fourth action zone 4400 before settling in the valid operating envelope 4500. As shown in FIG. 16, the system 1000 may start in the first action zone 4100 causing the compressor 1100 to be slowed down. This action may result in the system 1000 moving to the fourth action zone 4400, in which no change to the compressor's operation will take place, but the second fan 1250 will be directed to slow down, moving the system 1000 from the fourth action zone 4400 to the valid operating envelope 4500. This transition is indicated by curved arrow 4102 in FIG. 16. It is appreciated that the transition action arrow 4102 does not necessary represent exact operating points on the operating map 4000, but do generally describe the movement between zones through which the system 1000 may transition. It is also appreciated that while one multiple zone transition has been described for a heating mode, this is not an exhaustive listing of multiple zone transitions through which the system 1000 may move.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

It shall be further understood that the techniques, methods, controls, diagnostics, and logic disclosed herein may be implemented in a variety of software, hardware, firmware, and combinations thereof.

While the invention has been illustrated and described in detail in the drawings and foregoing description, the same is to be considered as illustrative and not restrictive in character, it being understood that only certain embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method for operating a compressor in a refrigerant loop, comprising:

starting the compressor;

analyzing one or more of a motor current waveform, a motor torque waveform, and a waveform of refrigerant pressure at a refrigerant outlet of the compressor; and determining the compressor is rotating in a reverse direction in response to at least one of:

determining the presence of a high frequency harmonic exceeding a first predetermined threshold on at least one of the one or more analyzed waveforms, and performing a fast Fourier transform (FFT) over a predetermined frequency band and determining the summation of the FFT amplitude within the predetermined frequency band on at least one of the one or more analyzed waveforms exceeds a second predetermined threshold; and stopping the compressor in response to determining the compressor is rotating in the reverse direction.

2. The method of claim 1, wherein the motor current waveform is related to q-axis current.

3. The method of claim 1, wherein the first predetermined threshold corresponds to the second predetermined threshold.

4. The method of claim 1, wherein the compressor is a scroll compressor.

5. The method of claim 1 wherein the frequency band is selected to differentiate normal operation and reverse operation for a plurality of different compressors.

6. The method of claim 5 wherein the frequency band encompasses different high frequency harmonics for the respective different compressors.

7. A system, comprising:

a refrigerant compressor including a dome and a refrigerant outlet; and a controller configured to analyze one or more of a motor current waveform, a motor torque waveform, and a waveform of refrigerant pressure at the refrigerant outlet, and to determine the compressor is rotating in a reverse direction in response to at least one of:

determining the presence of a high frequency harmonic exceeding a first predetermined threshold on at least one of the one or more analyzed waveforms, and performing a fast Fourier transform (FFT) over a predetermined frequency band and determining the summation of FFT amplitude within the predetermined frequency band on at least one of the one or more analyzed waveforms exceeds a second predetermined threshold;

wherein the controller is further configured to stop operation of the compressor in response to determining the compressor is rotating in the reverse direction.

8. The system of claim 7, wherein the compressor is a scroll compressor.

9. The system of claim 7, wherein the motor current waveform is related to q-axis current.

10. The system of claim 7, wherein the first predetermined threshold corresponds to the second predetermined threshold.

11. The system of claim 7, further comprising a variable frequency drive, an electric motor operatively coupled with the compressor, a refrigeration loop, a condenser, and an evaporator.

12. The system of claim 7 wherein the frequency band is adapted to differentiate normal operation and reverse operation for a plurality of different compressors.

13. The method of claim 12 wherein the frequency band covers different high frequency harmonics for the respective different compressors.

14. A method for operating a compressor in a refrigerant loop, comprising:

starting the compressor;

analyzing one or more of a motor current waveform, a motor torque waveform, and a waveform of refrigerant pressure at a refrigerant outlet of the compressor; and determining in connection with the analyzing that the compressor is rotating in a reverse direction in response to the presence of a high frequency harmonic exceeding a first predetermined threshold on at least one of the one or more analyzed waveforms; and controlling operation of the compressor in response to determining the compressor is rotating in the reverse direction.

15. The method of claim 14 wherein the act of controlling operation of the compressor in response to determining the compressor is rotating in the reverse direction comprises stopping the compressor.

16. The method of claim 14, wherein the motor current waveform is related to q-axis current.

17. The method of claim 14, wherein the analyzing includes performing a fast Fourier transform (FFT) analysis on at least one of the waveforms.

18. The method of claim 14, wherein the first predetermined threshold corresponds to a second predetermined threshold.

19. The method of claim 14, wherein the compressor is a scroll compressor.

20. A system, comprising: a refrigerant compressor including a dome and a refrigerant outlet; and a controller configured to analyze one or more of a motor current waveform, a motor torque waveform, and a waveform of refrigerant pressure at the refrigerant outlet, perform a fast Fourier transform (FFT) on a predetermined frequency range, evaluate whether a summation of the FFT amplitude in the predetermined frequency range exceeds a predetermined threshold, determine that the compressor is rotating in a reverse direction in response to a determination that the summation of amplitude within a frequency band on at least one of the one or more analyzed waveforms exceeds the predetermined threshold, and control operation of the compressor in response to determining the compressor is rotating in the reverse direction.

21. The system of claim 20, wherein the wherein the controller is configured to stop the compressor in response to determining the compressor is rotating in the reverse direction.

22. The system of claim 20, wherein the compressor is a scroll compressor.

23. The system of claim 20, wherein the motor current waveform is related to q-axis current.

24. The system of claim 20, further comprising a variable frequency drive, an electric motor operatively coupled with the compressor, a refrigeration loop, a condenser, and an evaporator.

25. The system of claim 20 wherein the frequency range is configured to differentiate normal operation and reverse operation for a plurality of different compressors.

26. The method of claim 25 wherein the frequency range covers different high frequency harmonics for the respective different compressors.

* * * * *